United States Patent [19]

Holliday

[11] 3,938,801

[45] Feb. 17, 1976

[54] CONTINUOUS OPERATING COLLATOR

[76] Inventor: David H. Holliday, 21315-80th West, Apt. 11, Edmonds, Wash. 98020

[22] Filed: Aug. 19, 1974

[21] Appl. No.: 498,454

[52] U.S. Cl. ..... 271/173; 270/58
[51] Int. Cl.[2] ..... B65H 31/24
[58] Field of Search ..... 271/64, 173; 270/58

[56] References Cited

UNITED STATES PATENTS 2,920,888 1/1960 Smith ..... 270/58
3,740,050 6/1973 Jacobs ..... 270/58

*Primary Examiner*—Evon C. Blunk
*Assistant Examiner*—Robert Saifer
*Attorney, Agent, or Firm*—Thomas W. Secrest

[57] ABSTRACT

This invention is for a collator for business papers wherein multiple copies and multiple pages are prepared. The collator, for the same page, can run continuously thereby saving time and money and paper. The collator comprises bins, arranged with one bin above the other bin, and with the bins offset from each other so as to appear to be at an angle.

29 Claims, 10 Drawing Figures

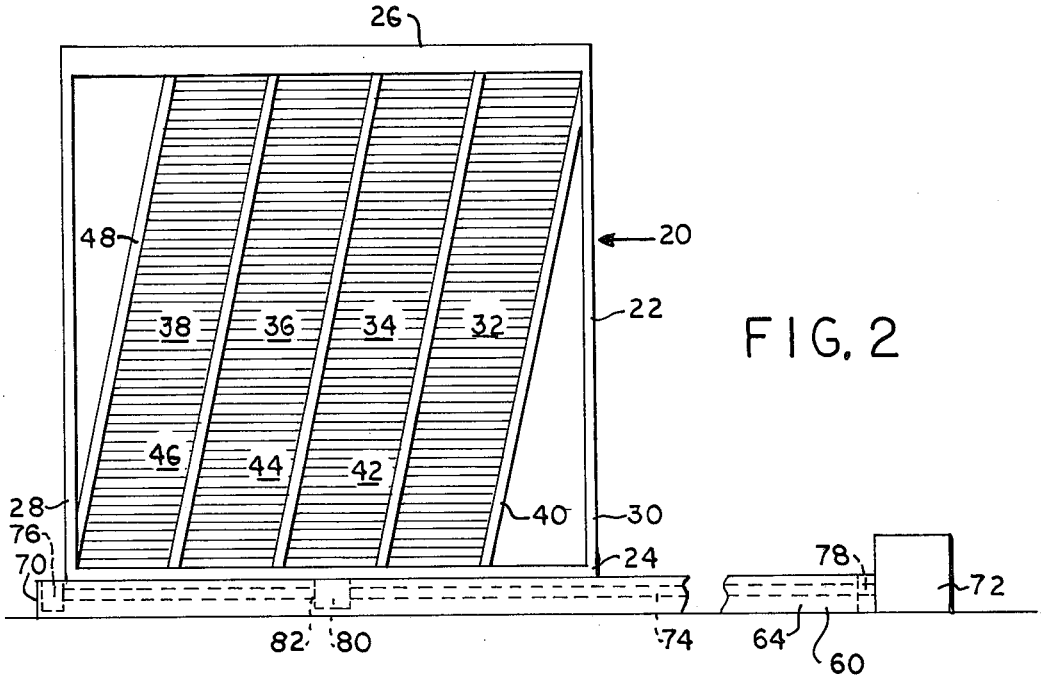
FIG. 2
FIG. 1
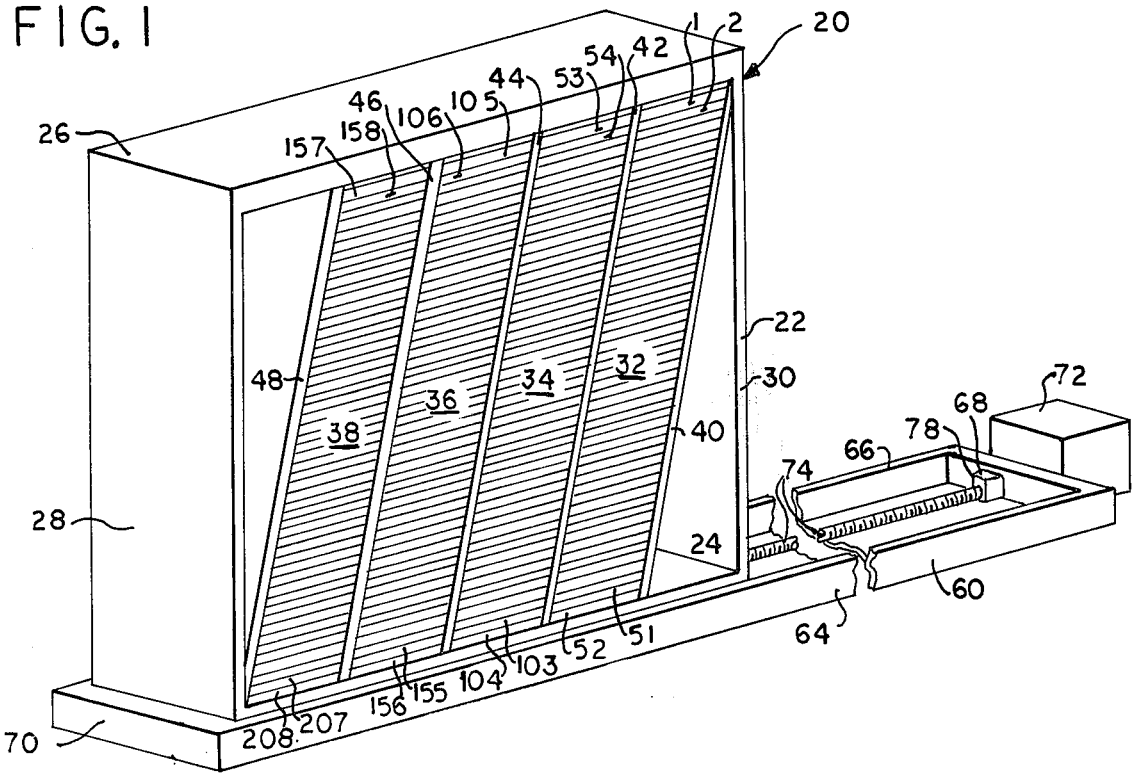

CONTINUOUS OPERATING COLLATOR

GENERAL BACKGROUND OF THE INVENTION

In many places there are reproduction centers or inplant reproduction centers. For example, in industry there are inplant reproduction centers. In commercial houses there are inplant reproduction centers. Also, in various government agencies there are inplant reproduction centers. These reproduction centers may produce cataloges, maintenance manuals for equipment, instruction books for operating equipment, brochures, sales material and specifications for bidders to use in making a bid. These are only a few of the uses to which a reproduction centers may be used.

In a reproduction center there is used a printing machine such as an offset duplicator. The printed material from the offset duplicator must be collated so as to be made into the catalog, manual, instruction book and the like. It is possible to collate the printed material by hand. However, the cost of collating material manually is expensive and therefore self-defeating. As a result, at the present time, very few places use manual labor to collate the printed material.

In the last few years, in order to lessen the manual labor in the collation process and in order to lessen the cost and also to lessen the time required for collating, there has been developed apparatus to assist in the collating of the printed material. This apparatus has taken the form of a series of vertical bins. Each bin receives a copy of the printed material. There is a feeding apparatus for feeding the printed material to the bins. From experience, the number of vertical bins in a vertical column has been established as 52 bins. The feeding apparatus in feeding the printed material or printed sheet to a column of bins will feed the necessary sheets to one column of bins and then the column of bins in the feeding apparatus will move with respect to each other. In this time that the column of bins and the feeding apparatus move with respect to each other, the offset duplicator or printing apparatus is not operating. As a result, the image thickens and there becomes excess ink on the printing plate. The excess ink, upon being printed upon the next sheet of paper, appears messy and sloppy. In order to remove the excess ink from the printing plate, it is necessary to run a number of printed sheets such as say, ten printed sheets. This means that ten printed sheets have been wasted in order to clean the printing plate. This can be translated into a waste of time as well as a waste of paper. The press speed of many duplicators is nine thousand sheets per hour which means one hundred fifty sheets per minute or two and one-half sheets per second. With a collator having 52 bins in a vertical column, there is required approximately 3 to 4 seconds to move the bins and the feeding apparatus with respect to each other. Then, to start the offset duplicator printing, again, there is required another three-to-four seconds. Then to clean the printing plate, there is required about 10 copies of printed material or about 4 seconds. It is seen that this process of stopping the printing apparatus, moving the feeding apparatus and the vertical bins with respect to each other and then starting the printing apparatus again, requires from 10 to 12 seconds. To print the material to go into 52 bins requires approximately 20 seconds. In other words, the printing apparatus, the feeding apparatus, and the collating apparatus are wasting about one-half of the time required to print the printed page.

If the collating apparatus can function continuously, then there is a saving of approximately one-third of the time as it is not necessary to stop the printing apparatus. The printed pages can be printed continuously and collated into the bins.

It is my understanding that, at the present time, when a catalog or a maintenance manual or an instruction book or other multiple copies and pages are printed and collated the national average of copies is about 65 copies. As there are 52 bins in a vertical column of bins, this means that there must be two vertical columns of bins or one hundred four bins. A large bank of bins will have 624 bins. Again, to repeat, from the above calculation, if there is used a continuous operating collator there is saved about one-third of the time required in printing the printed sheet and in collating the printed sheet. A saving of one-third in time is a large percentage of saving or a large saving in time.

GENERAL DESCRIPTION OF THE INVENTION

This invention is directed to a collator comprising bins. The bins may be in a, substantially, vertical column or may be in a spiral. The bins in a spiral may be positioned along a horizontal spiral or may be in a vertical spiral or at an angle.

The adjacent and successive bins are offset from each other so that the bins move a short distance or move in increments of a predetermined distance to accept a sheet of material from the feeding mechanism. The collator or bins and the feeding mechanism move with respect to each other.

If the bins are positioned in a, substantially, vertical column, the bins are offset from each other so that in two adjacent columns the top bin in the second column, substantially, overlies the bottom bin in the first column. In this manner the feeding mechanism can continually feed a sheet of material such as a printed page to the collator without having to stop to move the collator and the column of bins a distance equal to the width of the bins.

If the bins are in a spiral, the adjacent and succesive bins are offset from each other a slight distance or are offset in increments of a predetermined distance so that with the rotation of the bins in the spiral a new receiving bin is positioned adjacent to the feeding mechanism or feeding apparatus to receive the sheet of material from the feeding apparatus.

There is means to move the bins and the feeding apparatus relative to each other so as to have a new receiving bin in an acceptance position with respect to the feeding apparatus.

OBJECTS AND ADVANTAGES

One of the objects of this invention is to provide a collator and a system for collation wherein there is less waste of sheet materials such as printed paper than with prior used equipment and methods; another important object is to provide an apparatus and a system for collation where there is less cost than with prior used equipment and apparatus; another important advantage is to provide equipment and a system wherein there is a considerable saving in time as compared with the present equipment and systems available and which saving in time may be as great as a fifty percent saving in time; an additional object is to provide equipment and a process for collation wherein there is a saving in labor in the press time and therefore a saving of money; a further important object and advantage is to provide equipment and apparatus wherein an increase in production of the sheet material or printed material for the same printing apparatus and for the same amount or quantity of labor; a further important object is to provide equipment and process for producing a better quality of printed paper or printed material; and, a further and important object is to provide, in certain instances, equipment and a process which inherently has a greater storage capacity for sheet material or printed material for a given floor area than was attainable with prior available equipment and methods.

These and other important objects and advantages of the invention will be more particularly brought forth upon reference to the detailed description of the invention, the appended claims and the accompanying drawings.

THE DRAWINGS

FIG. 1 is a perspective view looking at specific embodiment of the collator and illustrating the columns of offset bins and the means for moving these columns;

FIG. 2 is a front elevational view of the collator;

FIG. 5 is a perspective view looking at the position of the collator and the feeding mechanism wherein the feeding mechanism can feed sheet material into the top receiving bin of the first column of the collator;

FIG. 6 is a perspective view illustrating the relative position of the collator and the feeding mechanism, after the two have moved with respect to each other as compared with FIG. 5, and illustrates the feeding mechanism feeding sheet material into a bin in the middle part of the first column;

Figure 6:
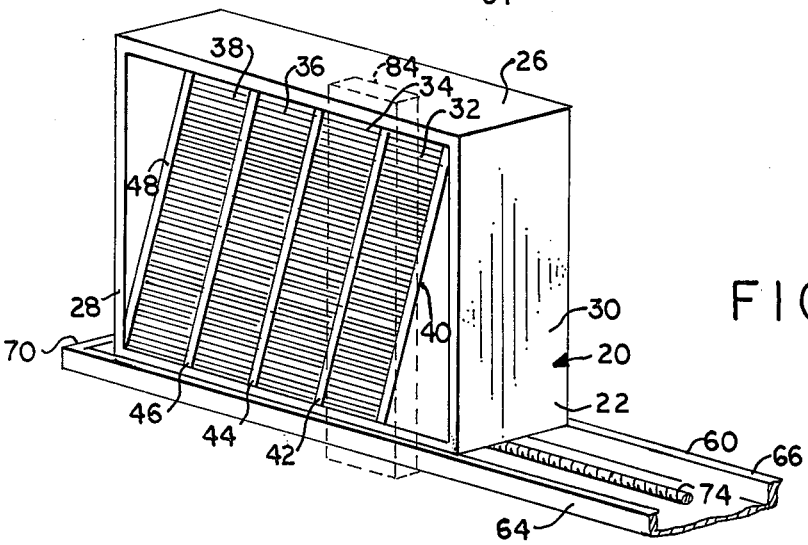
Figure 7:
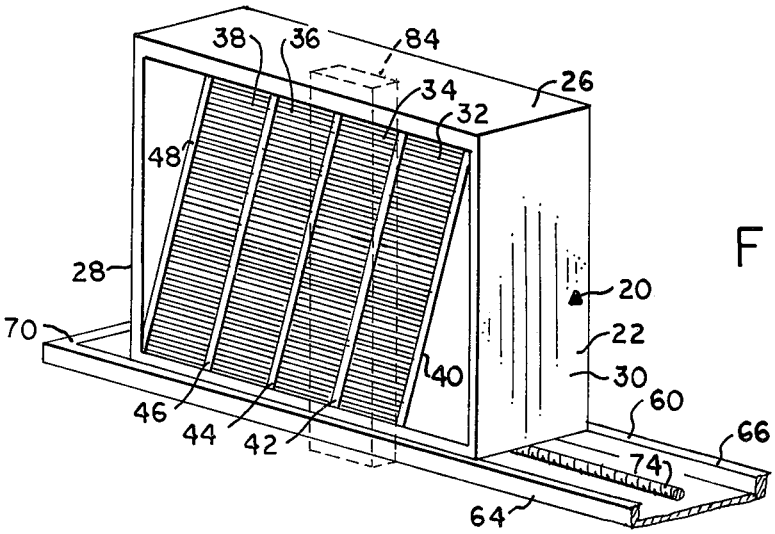
Figure 8:
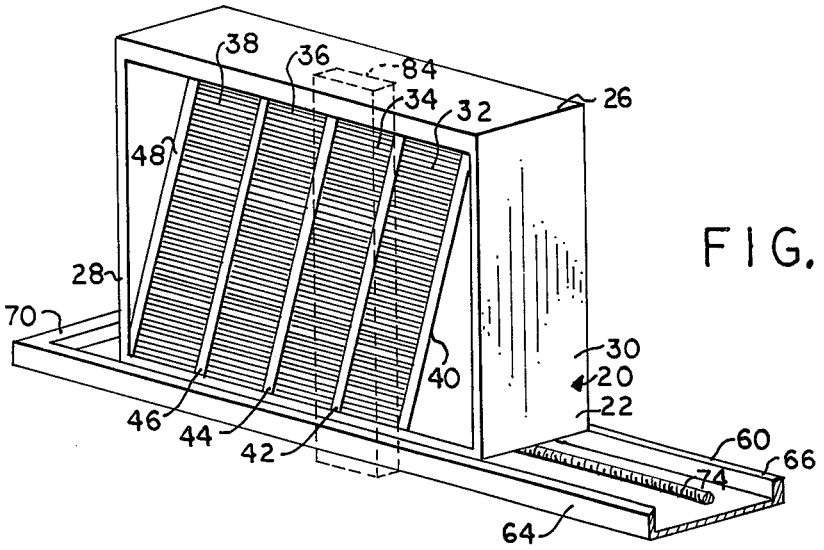
Figure 9:
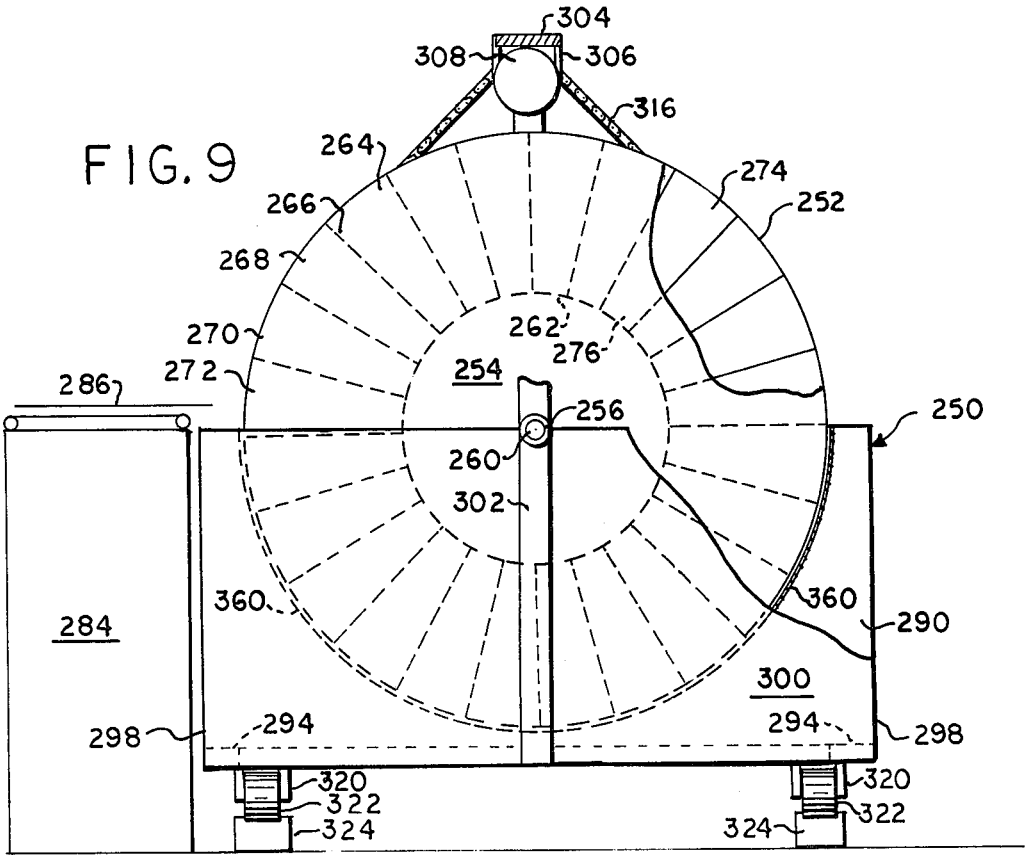
Figure 10:
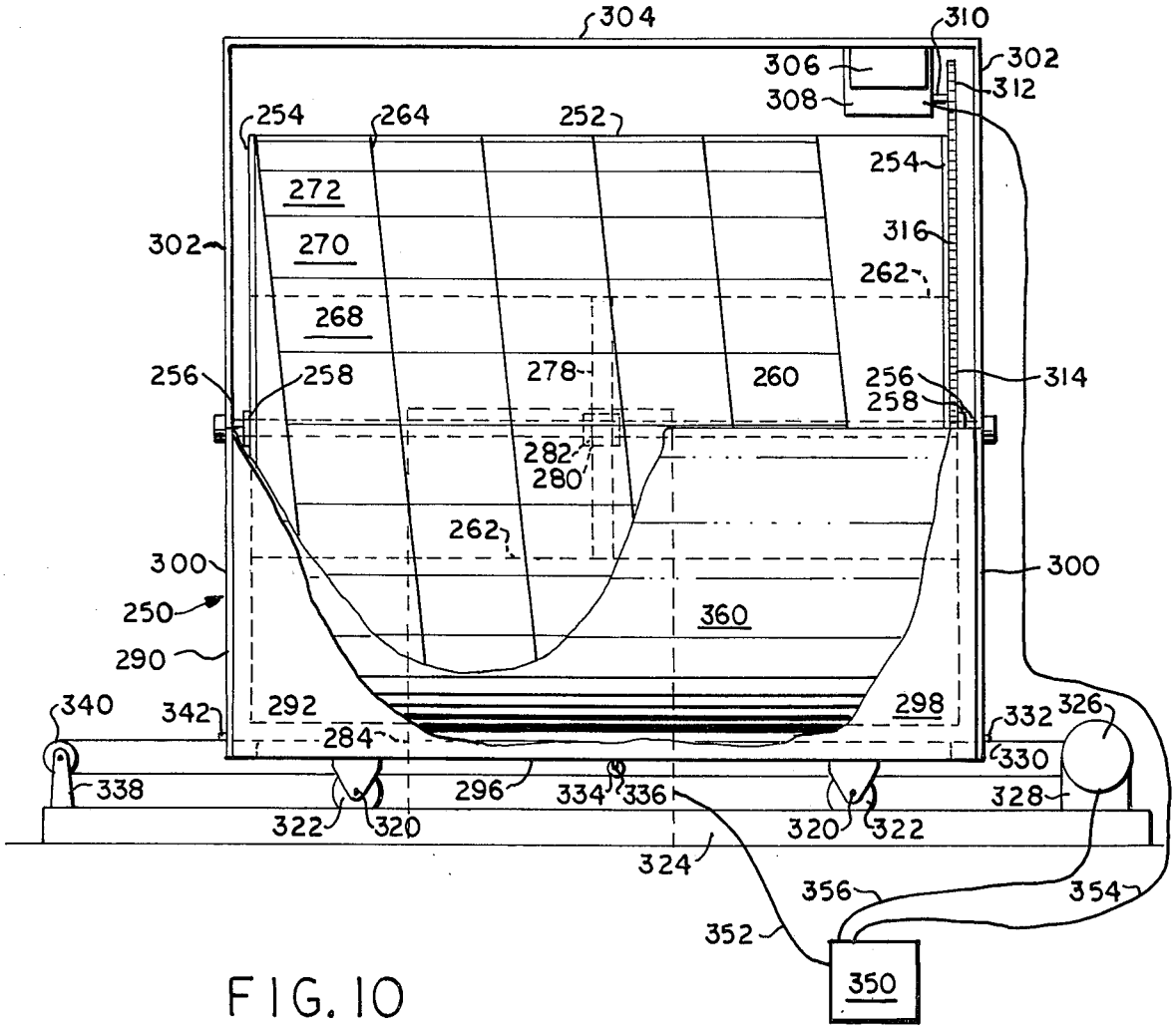

FIG. 7 is a perspective view looking at the relative position of the collator and the feeding mechanism after the collator and the feeding mechanism have moved with respect to each other as compared to FIG. 6 and illustrates the feeding mechanism feeding of sheet material into one of the lowest receiving bins in the first column and also feeding sheet material into the top receiving bin in the second column;

FIG. 8 is a perspective view looking at the collator and the feeding mechanism and illustrates the relative movement of the collator and the feeding mechanism as compared with the position of the collator and the feeding mechanism in FIG. 7 and also illustrates the feeding of sheet material into the bottom receiving bin in the first column and into an upper receiving bin in the second column;

FIGS. 9 and 10 are illustrative of a continuous rotary collator wherein FIG. 9 is a front elevational view and illustrates the cylindrical drum for holding the sheet material and the rotating cylindrical drum; and, FIG. 10 is a side elevational view illustrating means for rotating the cylindrical drum, the arrangement of the bins in a spiral pattern on the cylindrical drum, and means for moving the cylindrical drum past an off-line feeder for feeding the sheet material to said bins.

SPECIFIC DESCRIPTION OF THE INVENTION

In FIGS. 1 and 2 there is illustrated the collator 20. The collator 20 comprises a bin frame 22 having a bottom support and guide rail 24 and a top rail 26. The bottom rail 24 and the top rail 26 are connected by stiles 28 and 30 to form the upright integral bin frame 22.

In the bin frame 22 are four columns of bins; a first column of bins 32; a second column column of bins 34; a third column of bins 36; and a fourth column of bins 38. On each side of the first column of bins 32 are support members, a first support member 40 and a second support member 42. The second column of bins 34 is positioned between the second support member 42 and the third support member 44. The third column of bins 36 is positioned between the third support member 44 and the fourth support member 46. The fourth column of bins 38 is positioned between the fourth support member 46 and the fifth support member 48. It is seen in FIGS. 1 and 2 that the support members 40, 42, 44, 46 and 48 run at an angle or are diagonally spaced with respect to the bin frame 22 and that the support members are parallel to each other.

As previously stated, the standard collator has fifty-two bins in a column. In FIGS. 1 and 2 there are fifty-two bins in the first column and the top bin will be identified by reference numeral 1 and the next bin will be identified by reference numeral 2 and the bottom bin will be identified by reference numeral 52 and the next to the bottom bin will be identified by reference numeral 51. It is to be realized that between bins 2 and 51 in the first column there are 48 bins. In column 2 the top bin will be identified by reference numeral 53 and the next to the top bin will be identified by reference numeral 54. Also, in the second column the bottom bin will be identified by the reference numeral 104 and the next to the bottom bin in column 2 will be identified by reference numeral 103. It is to be realized that in the second column between bin 54 and bin 103 there are 48 receiving bins for sheets of material or printed material.

Likewise, in columns 3 and 4 there are 52 bins with the top bin in column 3 bearing reference numeral 105 and the next to the top bin bearing reference numeral 106 and the bottom bin in column 3 bearing reference numeral 156 and the next to the bottom bin bearing reference numeral 155. In the third column between bins 106 and 155 there are 48 bins. In the fourth column the top bin will bear reference numeral 157 and the next to the top bin will bear reference numeral 158 with the bottom bin bearing reference numeral 208 and the next to the bottom bin bearing reference numeral 207. In the fourth column between bin 158 and bin 207 there are 48 bins.

In a column of bins, and, for example, column number 32, it is seen that bins 1 and 2 are spaced apart an incremental distance or an increment of a predetermined distance so that bin number 1 does not, completely, overlie bin number 2 even though the bins in the columns are, substantially, vertically positioned. The adjacent bins in a column are offset from each other a short distance such as about one-quarter of an inch to one-half an inch. Or, in other words, bins 1 and 2 are offset from each other about one-quarter of an inch or one-half inch. In columns 1 and 2 the uppermost bin 53 in column 2 substantially overlies the next to the lower bin 51 in column 1 and the next to the upper bin 54 in column 2 overlies the lowermost bin 52 in column 1. With this arrangement of the bins, it is possible to introduce, substantially, simultaneously, sheets of material or printed pages into bins 53 and 51 and likewise to introduce, substantially, simultaneously, sheets of material or printed pages in the bins 54 and 52 so as to continuously feed the printed pages to the collator 20 without having to stop the feeding mechanism.

In FIGS. 1 and 2 it is seen that there is a support frame 60 having two spaced-apart sides 64 and 66 and two spaced-apart ends 68 and 70. The support frame 60 is integral. The support frame 60 supports the bin frame 22 and also acts as a guide for the rectilinear movement of the bin frame 22 in the support frame 60

At one end of the support frame 60, and outside of the end 68, there is a control and motor unit 72. The control and motor unit 72 connects with and drives a screw shaft 74.

Near the end 68 and inside the support frame 60 there is a bearing 78 and near the other end 70 there is a bearing 76 for the screw shaft 74.

There is attached to the bottom support and guide rail 24 and the bin frame 22 a lug 80 having a tapped center passageway 82. The screw shaft 74 passes through the tapped center passageway 82. The screw shaft 74 on rotating moves the bin frame 22 in a rectilinear path in the support frame 60.

Figures 3, 4:
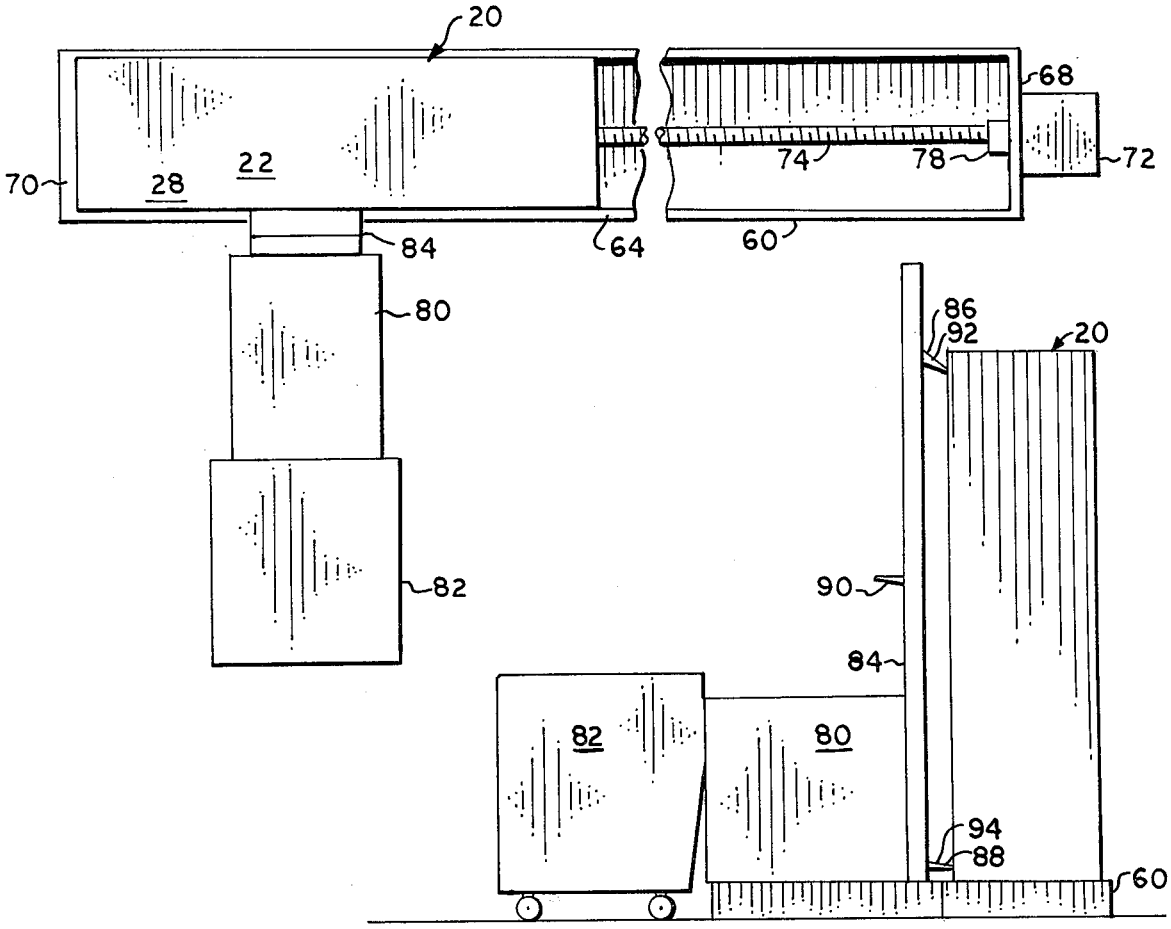
FIG. 3 is a top plan view of the collator, the feed table and the off-line feeder.
FIG. 4 is a side elevational view of the collator, the feed table and the off-line feeder.

In FIGS. 3 and 4 there is illustrated a feed table 80 and an off-line feeder 82.

This off-line feeder 82 is positioned adjacent to the feed table 80 so that the printed sheets of material are readily available to the feed table 80.

In FIG. 4 it is seen that the feed table 80 comprises a vertical column 84.

The vertical column 84 has three traveling feed paper ejector fingers 86, 88 and 90. The paper ejector fingers travel vertically and also move around the ends of the vertical column 84. In FIG. 4 it is seen that the ejector finger 88 is in a position to introduce a sheet of printed material 94 into bin 52 in the first column or column 32 and, substantially, simultaneously, to introduce a sheet of printed material 92 into a bin 53 in the second column 34.

It is to be clearly understood that the feed table 80 and the off-line feeder 82 are commercially available units. In fact, there are a number of manufacturers for the feed table 80 and the off-line feeder 82.

Figure 5:
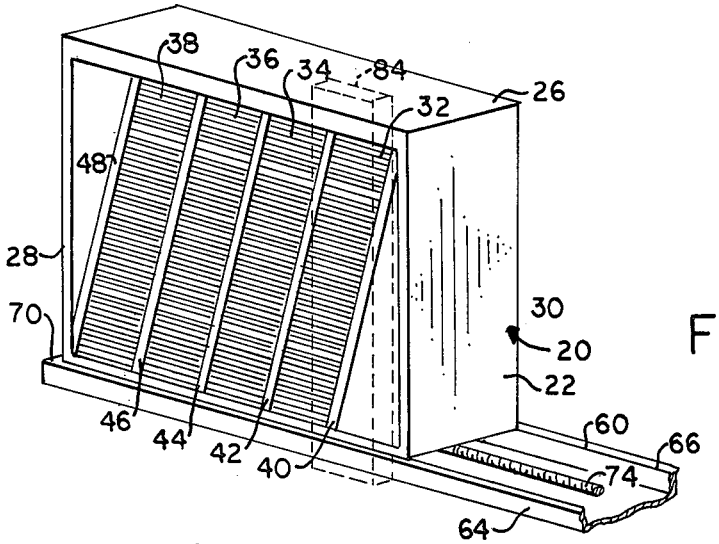
FIGS. 5, 6, 7 and 8 illustrate the relative movement of the collator and the feeding apparatus with respect to each other and the movement of the feeding apparatus for feeding into different bins in different columns in the collator.

In FIGS. 5, 6, 7 and 8 there is illustrated the movement of the column of bins with respect to the feed table 80 and the vertical column 84. In FIG. 5, the vertical column 84 and the ejector finger is so positioned as to introduce the printed paper into bin Number 1 in the first column or column 32. Then, in FIG. 6 the bin frame 22 has been moved so that the feed table 80 and the vertical column 84 are capable of introducing the printed page or printed paper into a bin in the middle of the first column or column 32 and which bin may be, for example, bin number 25. Then, in FIG. 7 the bin frame 22 has been moved horizontally with respect to the feed table 80 and the vertical column 84 so that an ejector finger is introducing a printed sheet or a printed page into bin 51 in the first column or column 32 and, substantially, simultaneously, introducing a printed sheet or a printed page into bin 53, the top bin, in the second column or column 34. Finally, in FIG. 8 the bin frame 22 has been moved horizontally with respect to the feed table 80 and the vertical column 84 so that the vertical column 84 is introducing a printed sheet or a printed page into the bottom bin 52 in the first column 32 and, substantially, simultaneously, introducing a printed sheet or printed page into the next to the top bin 54 in the second column 34.

In this manner it is seen that the feed table 80 and the vertical column 84 need not be stopped; but, can continuously feed the printed sheet or the printed page into the bins in the collator 20. In FIGS. 5 through 8 there are four columns of bins. Again, it is to be realized that there may be two columns of bin or many columns of bins, dependent upon the size of the printing unit and the capacity required. Once the feed table 80 and the vertical column 84 start feeding the printed page into the bins in the collator 20, it is possible to continuously feed all of that set of printed pages or printed sheets into the collator without stopping the feed table 80 and the vertical column 84. Naturally, with a new set of printed sheets, such as a new printed page, it is necessary to start feeding the printed sheets again. More particularly, there may be 175 copies of page number 1 and these 175 copies can be continuously collated. Then, there will 175 copies of page number 2; and, it will be necessary to start the collation step and process over again for the page 2. But, once the 175 copies of a printed sheet are introduced into the collator 20, the collation process can continue until all of that sheet, such as sheet 1 or sheet 2, is collated.

In FIGS. 9 and 10 there is illustrated a continuous rotary collator 250.

The collator 250 comprises a cylindrical drum 252.

The cylindrical drum 252 comprises circular end support plates 254 having a central passageway 256. In each of the passageways 256 there is a bearing 258. A shaft 260 is positioned in the bearing 258.

There connects with the circular end support plates 254 an inner support cylinder 262. There is attached to the inner support cylinder 262, by tack welding or other suitable means, a spiral strip 264. The spiral strip winds around the inner support cylinder 262 and functions as a divider between bins in the cylindrical drum 252.

In FIG. 9 it is seen that there are a number of radial dividers 266 which are attached to the spiral strip 264 and also to the inner support cylinder 262. The radial dividers may be attached by means of tack welding or other appropriate means. The radial dividers 266 form a plurality of bins such as 268, 270 and 272 for illustrative purposes.

In FIG. 10 it is seen that said bins are in a, substantially, overlapping relationship. The bins 268, 270 and 272 are in a, substantially, overlapping relationship. The bin 270, termed a first bin, is exposed on one edge with respect to the preceding bin 268 and is exposed on the other edge with respect to the succeeding bin 272. The bin 270 may be offset about ¼ inch to ½ inch from bin 268 and may be offset a like distance or a like amount from the bin 272. The bins 268 and 272 may be offset from each other a distance of about ½ inch to about 1 inch. In this manner, it is seen that by rotating the cylindrical drum 252 and also by longitudinally moving the cylindrical drum 252 there is exposed another bin for receiving sheet material.

From FIG. 9 it is seen that the opening 274 in a bin is larger than the inner end 276 of the bin.

In the interior of the inner support cylinder 262 there may be an interior circular brace attached to the inner support cylinder 262 and having a passageway 280. In the passageway 280 there is positioned a bearing 282 and in which bearing there is journaled the shaft 260.

There is an off-line feeder 284. The off-line feeder 284 is positioned next to the continuous rotary collator 250 and feeds sheet material 286 to an appropriate bin such as 268, see FIG. 9.

The off-line feeder 284 is permanently positioned. Therefore, it is necessary to provide means for rotating the cylindrical drum 252 and for moving longitudinally the cylindrical drum 252 past the off-line feeder 284 so as to expose a fresh bin for receiving the sheet material 286. In order to accomplish this there is provided a movable support means for the cylindrical drum 252 and means for rotating the cylindrical drum 252.

The movable support means for the cylindrical drum 252 comprises a carriage 290 having lateral beams 292 on the ends and longitudinal beams 294 on the sides.

There may be a bottom wall 296, side walls 298 and end walls 300 to form the carriage 290. The walls 296, 298 and 300 may be welded or bolted to the beams 292 and 294.

At the ends of the carriage 290 and attached to the lateral beams 292 and the end walls 300 are two upright central supports or two upright central standards 302. The top of the upright standards 302 are connected by a support rail 304. There depends from the support rail 304 a bracket 306 and which bracket connects with the motor 308. The motor 308 has an output shaft 310 and on the end of the output shaft 310 is a sprocket 312.

On one end of the cylindrical drum 252 is a sprocket 314. The sprockets 312 and 314 are aligned and are connected by a chain 316. As is, readily, appreciated the motor by means of the sprocket 312, the chain 316 and the sprocket 314 drive the cylindrical drum or rotate the cylindrical drum 252.

To longitudinally move the carriage 290 and the cylindrical drum 252 there is provided a moving means. On the front and the rear of the carriage 290 and positioned or supported by the bottom wall 296 and the lateral beams 292 are axles 320. On the ends of the two axles 320 are the wheels 322. The wheels 322 ride on two spaced-apart tracks or rails 324. There may be a motor and reel combination 326 mounted on a support or pedestal 328. The motor and reel combination 326 are positioned away from one end of the carriage 290. A cable or rope 330 connects with the end wall 300 by means of a bracket 332. The cable 330 winds around the reel and motor combination 326 and underneath the bottom wall 296 of the carriage 290. The cable may pass around a pulley 334 and which pulley 334 is attached by means of a bracket 336 to the bottom wall 296.

Spaced apart from the other end of the carriage 290 is a support 338 and on which support 338 there is mounted a pulley 340. The cable 330 passes underneath or around the pulley 334, around the pulley 340 and attaches to the other end of the carriage 290 by means of a bracket 342.

From this description it is seen that by operating the motor and reel combination 326 it is possible to move, rectilinearly, the carriage 290 past the off-line feeder 284.

There is a control unit 350 and which control unit connects with the off-line feeder 284 by means of electrical cable 352, connected to the motor 308 by electrical cable 354 and to the reel and motor 326 by means of electrical cable 356.

It is seen that the control unit 350 controls the motor 308 for rotating the cylindrical drum 252 for positioning a bin with respect to the off-line feeder 284. Simultaneously, the control unit 350 controls the motor and reel combination 326 for, rectilinearly, moving the carriage 290 and the cylindrical drum 252 next to the off-line feeder 284 and thereby positioning the bin next to the off-line feeder 284. And, the control unit 350 controls the off-line feeder 284 for feeding sheet material 286 to the bin positioned next to the off-line feeder 284. In other words, it is possible to rotate the cylindrical drum 252 and to rectilinearly move the cylindrical drum 252 to position a bin for receiving sheet material 286 from the off-line feeder 284.

The continuous rotary collator 250 can accept a large number of printed pages or a large number of sheet material such as printed or copied pages in the bins. For example, the continuous rotary collator 250 can accept page 1 of a document, then the process can be repeated for the continuous rotary collator to accept page 2 and to continue this process until all of the pages of the document have been fed into the respective appropriate bins in the collator 250.

In FIG. 9 it is seen that there is a retaining shield 360 and which retaining shield is underneath the cylindrical drum 252. The reason for the retaining shield 360 is to prevent the sheet material in the bins, which are in the lower half of the cylindrical drum 252, from falling out of the bins. Naturally, due to the force of gravity the sheet material in the bins in the lower half of the cylindrical drum 252 will tend to fall out. Therefore, it is necessary to have the retaining shield 360.

From the foregoing, it is seen that I have provided two types of continuous collators. It is possible to feed all of one sheet material to these continuous collators and then to repeat the process as many times as necessary to prepare a document or a book or the like. Further, it is not necessary to shut down the printing machine and start up the printing machine once the collating process is underway. The printing machine can be started, the collating process can be initiated and all of that particular sheet of material such as page 1 of material can be fed, continuously, or in one continuous operation, to the collator. There is a resultant saving in time over the intermittent stopping of the collator, a resultant saving in labor, a resultant saving in material as some of the printed sheet material is not wasted due to the ink thickening on the printing machine, and as a result of these savings there is a resultant saving in cost.

From the foregoing and having presented this invention, what I claim is:

1. A collator comprising:

a. at least two columns identified as a first column and a second column, b. each column having a plurality of bins;

c. said columns being juxtapositioned to each other;

d. said columns being on a bias at a slant;

e. said bins being, substantially, horizontal;

f. an upper bin, partially, overlying the next lower bin and, partially extending over the next lower bin; and, g. the top bins in the second column overlying, substantially, the lowest bin in the first column.

2. A collator according to claim 1 and comprising:

a. a first means to move the columns in increments of a predetermined distance; and, b. said predetermined distance being, substantially, the distance an upper bin extends over the next lower bin.

3. A collator according to claim 1 and comprising:
a. the top receiving bin in the second column overlying, substantially, the lowest receiving bin in the first column.

4. A collator according to claim 2 and comprising:
a. the top receiving bin in the second column overlying, substantially, the lowest receiving bin in the first column.

5. A collator according to claim 2 and comprising:
a. said top receiving bin extending over the lowest receiving bin by a distance equal to, substantially, said increment of a predetermined distance.

6. A collator according to claim 4 and comprising:
a. said top receiving bin extending over the lowest receiving bin by a distance equal to, substantially, said increment of a predetermined distance.

7. A collator according to claim 2 and comprising:
a. a platform, and,
b. said two columns being, movably, positioned on said platform.

8. A collator according to claim 7 wherein said first means moves
a. said two columns on said platform.

9. A collator according to claim 7 wherein said first means moves
a. said two columns on said platform said increment of a predetermined distance.

10. A collator according to claim 7 wherein said first means moves
a. said two columns on said platform in steps; and,
b. a step being equal in length to said increment of a predetermined distance.

11. A collator according to claim 6 and comprising:
a. a platform; and,
b. said two columns being, movably, positioned on said platform.

12. A collator according to claim 11 wherein said first means moves
a. said two columns on said platform.

13. A collator according to claim 11 wherein said first means moves
a. said two columns on said platform said increment of a predetermined distance.

14. A collator according to claim 1 wherein said first means moves
a. said two columns on said platform in steps; and,
b. a step being equal in length to said increment of a predetermined distance.

15. A combination of a collator and a feeding mechanism, said collator comprising:
a. at least two columns identified as a first column and a second column;
b. each column having a plurality of bins;
c. said columns being juxtapositioned to each other;
d. said columns being on a bias at a slant;
e. said bins being, substantially, horizontal;
f. an upper bin, partially, overlying the next lower bin and, partially extending over the next lower bin;
g. the top bins in the second column overlying, substantially, the lowest bin in the first column;
h. said feeding mechanism being positioned to introduce a material to a bin in a column;
i. said feeding mechanism being capable of introducing said materials to adjacent bins in a column;
j. said feeding mechanism being capable of introducing said materials to bins in adjacent columns; and,
k. means to move said collator and said feeding mechanism with respect to each other a distance equal to, substantially, the distance the upper bin extends over the next lower bin.

16. A combination according to claim 15 and comprising:
a. a first means to move the columns in increments of a predetermined distance; and,
b. said predetermined distance being, substantially, the distance an upper bin extends over the next lower bin.

17. A combination according to claim 15 and comprising:
a. the top receiving bin in the second column overlying, substantially, the lowest receiving bin in the first column.

18. A combination according to claim 16 and comprising:
a. the top receiving bin in the second column overlying, substantially, the lowest receiving bin in the first column.

19. A combination according to claim 16 and comprising:
a. said top receiving bin extending over the lowest receiving bin by a distance equal to, substantially, said increment of a predetermined distance.

20. A combination according to claim 18 and comprising:
a. said top receiving bin extending over the lowest receiving bin by a distance equal to, substantially, said increment of a predetermined distance.

21. A combination according to claim 16 and comprising:
a. a platform; and,
b. said two columns being, movably, positioned on said platform.

22. A combination according to claim 21 wherein said first means moves
a. said two columns on said platform.

23. A combination according to claim 21 wherein said first means moves
a. said two columns on said platform said increment of a predetermined distance.

24. A combination according to claim 21 wherein said first means moves
a. said two columns on said platform in steps; and,
b. a step being equal in length to said increment of a predetermined distance.

25. A combination according to claim 20 and comprising:
a. a platform; and,
b. said two columns being, movably, positioned on said platform.

26. A combination according to claim 25 wherein said first means moves
a. said two columns on said platform.

27. A combination according to claim 25 wherein said first means moves
a. said two columns on said platform said increment of a predetermined distance.

28. A combination according to claim 25 wherein said first means moves
a. said two columns on said platform in steps; and,
b. a step being equal in length to said increment of a predetermined distance.

29. A method for, continuously, collating sheet material, said method comprising:

a. positioning a first column and a second column of bins adjacent to each other;

b. each column having a plurality of bins;

c. positioning said bins in a column so that an upper bin, partially, overlies the next lower bin and, partially, extends over the next lower bin;

d. the top receiving bin in the second column overlying, substantially, the lowest receiving bin in the first column; and, e. feeding, continuously, said sheet material to said bins in said columns and in feeding said sheet material moving said sheet material and said columns with respect to each other both, horizontally, and, vertically.

* * * * *